US005441177A

United States Patent [19]

Yanagisawa

[11] Patent Number: 5,441,177

[45] Date of Patent: Aug. 15, 1995

[54] TONER CONTAINER AND TONER REPLENISHING DEVICE INCLUDING A CAP MEMBER HAVING A SHUTTER

[75] Inventor: Takaaki Yanagisawa, Yokohama, Japan

[73] Assignee: Ricoh Company, Ltd., Tokyo, Japan

[21] Appl. No.: 166,956

[22] Filed: Dec. 15, 1993

[30] Foreign Application Priority Data

Mar. 14, 1993 [JP] Japan ..... 5-080095

[51] Int. Cl.[6] ..... B67D 5/64

[52] U.S. Cl. ..... 222/167; 222/325; 222/DIG. 1

[58] Field of Search ..... 222/167, DIG. 1, 325; 141/364, 348, 349, 350, 383, 386

[56] References Cited

U.S. PATENT DOCUMENTS 3,526,341 9/1970 Johnston ..... 222/167
4,611,730 9/1986 Ikesue et al. .
4,615,364 10/1986 Kawata ..... 222/DIG. 1 X
4,744,493 5/1988 Ikesue et al. ..... 222/167
4,860,928 8/1989 Shimazu ..... 222/167
5,057,872 10/1991 Saijo et al. .
5,078,303 1/1992 Kikuchi et al. ..... 222/167

FOREIGN PATENT DOCUMENTS 58-97068 6/1983 Japan .

OTHER PUBLICATIONS

Patent Abstracts of Japan, vol. 7, No. 198 (P-220) (1343), Sep. 2, 1983, JP-A-58 097 068, Jun. 9, 1983.

*Primary Examiner*—Gregory L. Huson
*Attorney, Agent, or Firm*—Oblon, Spivak, McClelland, Maier, & Neustadt

[57] ABSTRACT

A toner container is rotatably mounted to a toner replenishing device for discharging toner thereto upon rotation of the toner container. The toner container includes a cylindrical member for containing toner to be discharged. A cap member covers the mouth portion of the cylindrical container and is rotationally mounted thereon. A shutter selectively closes an opening of the cap member. When the toner container is mounted to the toner replenishing device and rotationally driven thereby, the cap member is prevented from rotation and the shutter is opened to permit discharge of toner.

24 Claims, 7 Drawing Sheets

TONER CONTAINER AND TONER REPLENISHING DEVICE INCLUDING A CAP MEMBER HAVING A SHUTTER

BACKGROUND OF THE INVENTION

1. Field of the Invention

This invention relates to a toner container and a toner replenishing device for a copying machine, a facsimile or a printer, especially, to a container which rotates while being held in a toner replenishing device and to a toner replenishing device which rotates a toner container held thereby, to replenish toner.

2. Description of the Related Art

Such a toner container and a toner replenishing device are disclosed in U.S. Pat. No. 4,611,730, as shown in FIG. 7(*a*). In this toner container 1, an opening which is formed on an end of a cylindrical member 2 is covered with a screw cap 3 during transportation or storage. The toner container is attached to the toner replenishing device after the toner container is shaken sufficiently and the cap 3 is taken off, as shown in FIGS. 7(*b*) and (*c*). On a peripheral wall of this cylindrical member is formed a gear 4 which is supplied with a torque from the toner replenishing device. Furthermore, a spiral rib 5 extends along the inner wall of the cylindrical member 2 to gradually feed toner toward the mouth side of the cylindrical member in response to the rotation of the cartridge.

Japanese Patent 63-50876 discloses a toner replenishing device to which toner container 1 may be attached. An axis is provided on the toner container holder. The toner container on a toner container holder is pivoted around the axis of the toner container holder. An outlet cleaning member for cleaning a toner discharging outlet is fixed to the axis of toner container holder. A rotating mechanism in the toner replenishing device rotates upon rotation of the toner container holder and stops in a position where the cleaning member closes a connecting mouth between the toner container and the replenishing device when the toner container holder is pivoted to a position where the empty toner container may be taken off for replacing.

FIG. 8 shows a toner container which is different from the toner container of the type described above. There, the toner container 2 does not rotate, and a toner transporting member 6 is provided within the toner container 2. The toner transporting member 6 is rotationally driven by an engaging member 7 which extends through an end wall of the toner container 2. A toner discharging mouth of the toner container is formed in the peripheral wall of the toner container and a shutter 8 for opening and closing the toner discharging mouth is provided on the peripheral wall. Since this toner container incorporates a separate toner transporting member 6, it is expensive which is especially undesirable in a disposable part.

While the toner container of FIG. 7 is less expensive, it has other shortcomings. The toner container has to be attached to the toner replenishing device after shaking the container and taking off the cap. However, the shaking causes the toner to form an aerosol and, when the operator takes off the cap, the operator's hands or clothes can be dirtied. Moreover, in case that the operator drops the toner container when the cap is removed, a large amount of toner will spill out.

SUMMARY OF THE INVENTION

The present invention has as an object to overcome the above and other problems encountered in the aforementioned art.

It is a further object of the invention to provide a toner container and a toner replenishing device which prevent toner from spilling out from the container before the toner container is attached to the toner replenishing device.

The above and other objects of the present invention are achieved by a toner container rotatably mounted to a toner replenishing device for discharging toner to the toner replenishing device upon rotation of the toner container. The toner container includes a cylindrical member for containing toner to be discharged, the cylindrical member having a mouth portion adjacent one end thereof. It also includes a drive element coupled to the cylindrical member for transmitting rotational torque to the cylindrical member when the cylindrical member is mounted to the toner replenishing device, as well as a cap member covering the mouth portion and mounted relative to the cylindrical member such that the cap member can remain stationary when the cylindrical member is rotated, the cap member having an opening through which toner can be discharged. A shutter is mounted so as to selectively close the opening.

According to a further feature of the invention, the aforementioned toner container is combined with a toner replenishing device to form a toner replenishing system. The toner replenishing device includes a holder portion which receives the cap member when the cylindrical member is rotatably mounted thereto, as well as a portion which prevents rotation of the cap member when the cylindrical member is rotatably mounted thereto, and a shutter opening portion which opens the shutter when the cylindrical member is rotatably mounted thereto. A drive portion rotationally drives the drive element of the toner container.

According to yet a further feature of the invention, the cap member comprises a cap element having a rotational mounting part which is cooperable with the cylindrical member for the rotatably mounting the cap element to the cylindrical member. A cap opening is provided in the cap element for discharging toner when the cap element is mounted to the cylindrical member. A shutter opens or closes the cap opening and has an engaging portion for engaging with a shutter mechanism of the toner replenishing device when the cap member is mounted to the rotatable member in the toner replenishing device.

With the cap member covering the mouth of the toner container, the toner container is attached to the main body of the toner replenishing device. Until at this time, the toner discharging opening of the cap member is closed. Once the toner container is held in a container holder of the toner replenishing device, a shutter for opening and closing the toner discharging opening of the cap member may be opened and the contained toner discharged through the toner discharging opening by rotating the toner container using a driving part. Since the cap member of the toner container is rotationally movable on the toner container and is held by a holding member, the cap member does not rotate.

BRIEF DESCRIPTION OF THE DRAWINGS

Other objects and further features of the present invention will become apparent from the following detailed description when read in conjunction with the accompanying drawings, wherein:

FIG. 4(*b*) is a perspective view showing a shutter according to the invention which is in an open position;

FIG. 7(*b*) and (*c*) are views showing operations of taking off a cap of the conventional toner container.

DESCRIPTION OF THE PREFERRED EMBODIMENT

A description will now be given of preferred embodiments of a toner container and a toner replenishing device according to the present invention using an electrophotographic copier.

First, a toner replenishing device according to the present invention will be explained referring to FIG. 1 and FIG. 2.

Figure 1:
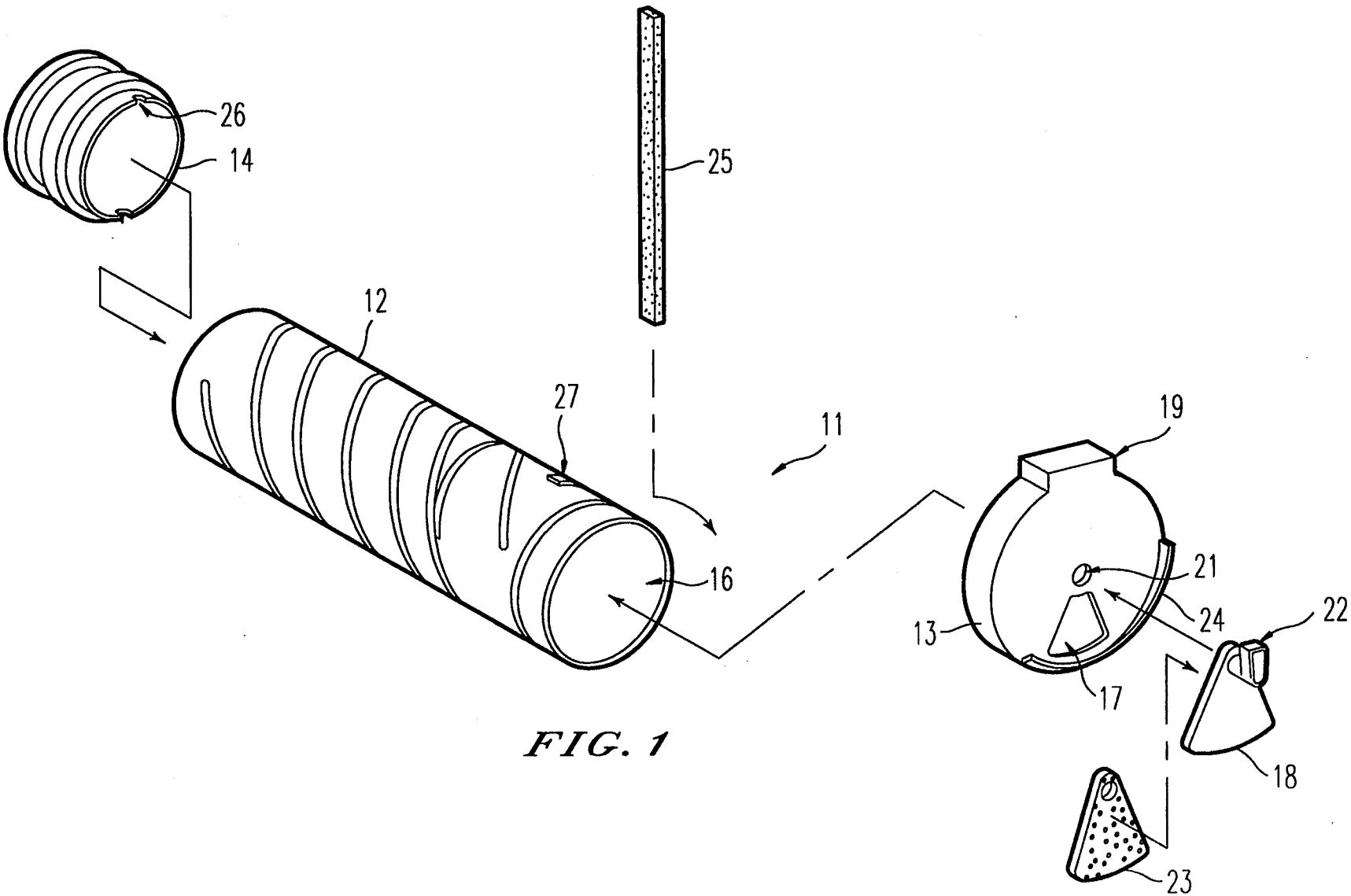
FIG. 1 is a perspective exploded view of a toner container according to the invention.

FIG. 1 is a perspective exploded view of a toner container 11.

Figure 2:
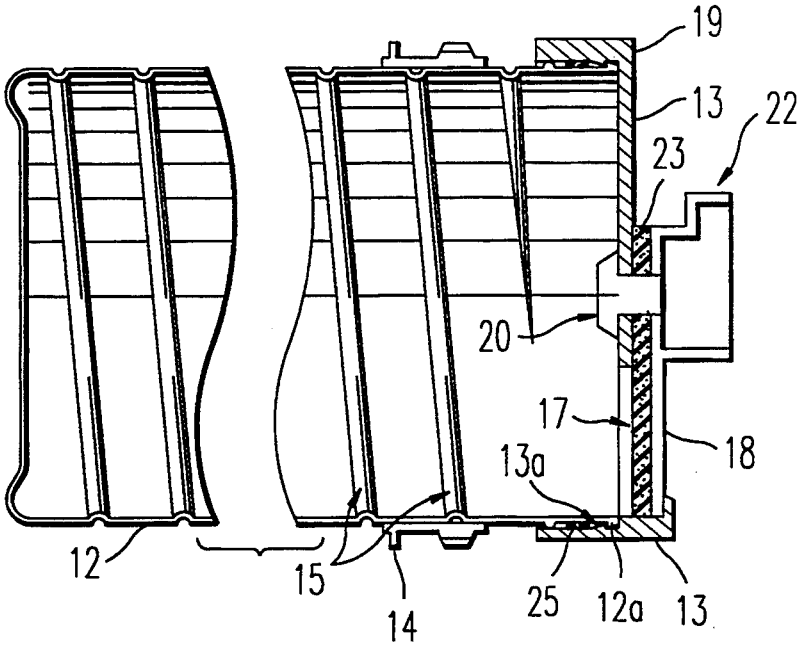
FIG. 2 is a longitudinal sectional view showing a toner container according to the invention.

FIG. 2 is a longitudinal sectional view showing a toner container 11.

The toner container 11 comprises three major components: a cylinder member 12 which has a mouth portion on an end 16, a cap 13 which is comprised of a cap element having a shape capable of covering the mouth portion and which is rotationally movable on the cylinder member 12, and a gear 14 which is mounted to the cylindrical member 12 and can be supplied with torque from the toner replenishing device.

Figure 3A:
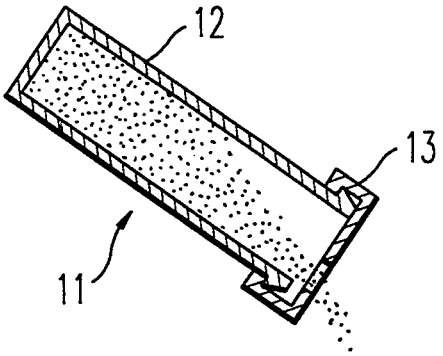
FIGS. 3(*a*) and (*b*) are sectional views showing cylinder members according to further embodiments according to the invention.
Figure 3B:
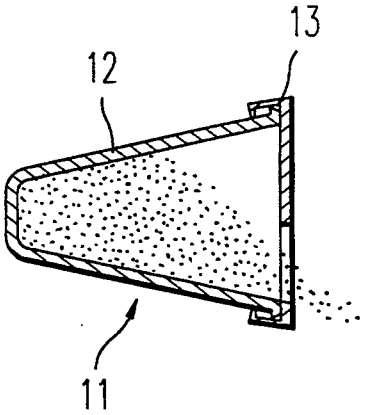

On an inner peripheral surface of the cylinder member 12 is provided spiral rib 15 for transporting toner, wherein the contained toner is transported toward the mouth portion end 16 by the rib 15 when the cylinder member 12 rotates. The rib is useful for transporting toner when the cylinder member 12 is attached to the toner replenishing device horizontally (or so that the mouth portion end 16 faces upward) as shown in FIG. 2. When the mouth portion is attached facing downward as shown in FIG. 3(*a*) or when a shape of the inner peripheral surface is constructed so that it gradually inclines downwardly toward the mouth portion end 16, so that the inner surface inclines in the attached position as shown in FIG. 3(*b*), it is possible to transport toner without the rib 15. The container is made of resin such as PE (polyethylene) or PS (polystyrene). It can also be made of paper. To get a high degree of transporting efficiency, it is desired to choose materials such that toner does not adhere to the inner peripheral surface of the cylinder member 12.

The cap 13 is rotationally movable on the cylinder member 12 and is constructed so that the cap 13 does not rotate with respect to the toner replenishing device in spite of the rotation of the cylinder member 12, when the container is mounted to the toner replenishing device. On an outer peripheral surface of the cylinder member 12 is formed an annular projection 12*a* as shown in FIG. 2, and on an inner peripheral wall of the cap 13 is formed an annular engaging projection 13a as a rotational mounting part which can engage with the projection 12*a* to prevent separation of the cap and cylinder in an axial direction once the projection 12*a* has engaged with the engaging projection 13*a* and so that the cap 13 and the cylinder member 12 can rotate relative to one another.

Figure 4A:
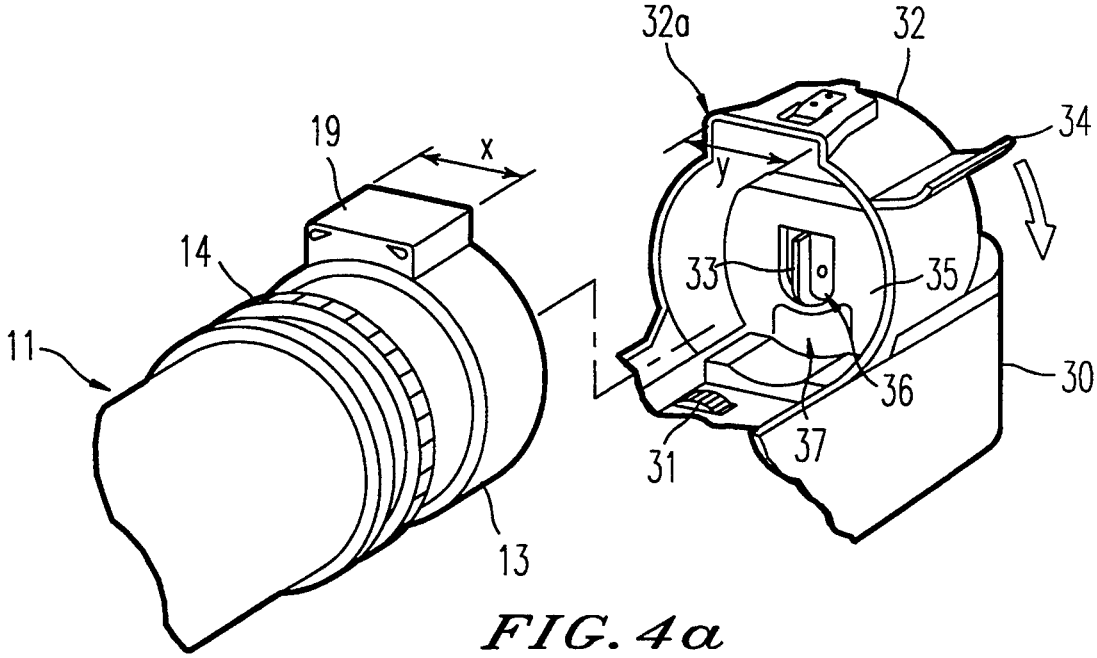
FIG. 4(*a*) is a perspective view showing an important part of a toner replenishing device cooperating with a toner container according to the invention.
Figure 4B:
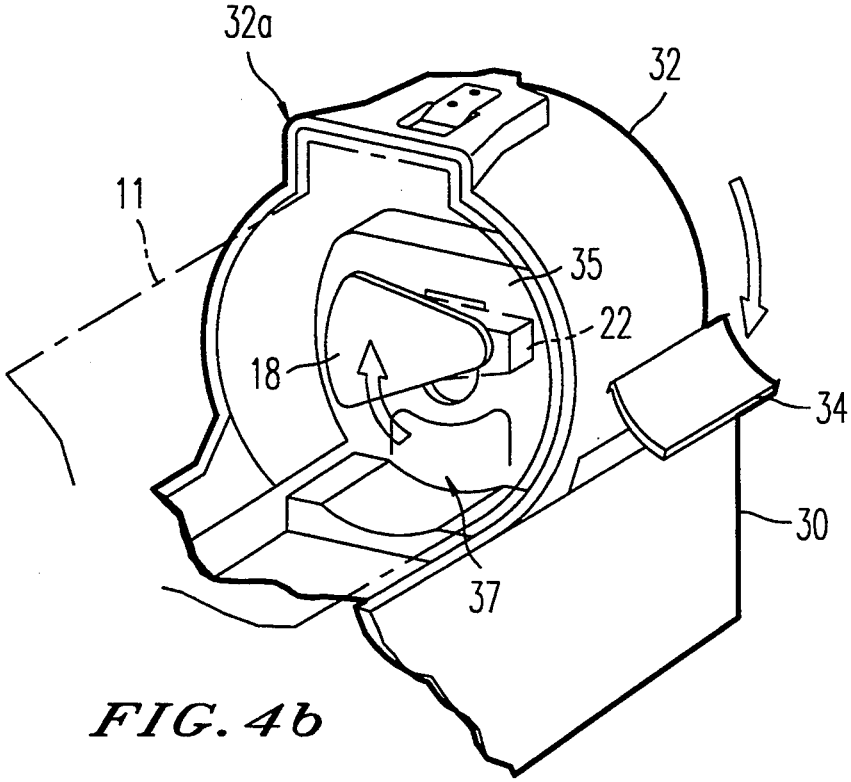

A cap opening 17 for discharging toner is formed on a side wall of the cap 13 which covers the mouth portion end 16 of the cylinder member 12. Preferably, the shape of the cap opening 17 is a sector shape which is wider at its radially outer end to reduce discharge resistance. A cap side engaging portion 19, which engages with a cap stopper portion 32*a* of the cap cover 32 (as shown in FIG. 4) is formed on the cap 13 so that the cap does not rotate with the cylinder member 12. The cap side engaging portion 19 has preferably has a simple shape which is easy to handle and position by the operator when the toner container 11 is attached to the toner replenishing device. The cap 13 is made of resin such as acrylonitrile-butad-styrene (ABS) or polystyrene (PS), etc.

A peripheral seal member 25 adheres to the cylinder member 12 to prevent toner from leaking from a gap between the cylinder member 12 and the cap 13. Preferably, the peripheral seal member 25 is made of stable materials such as a foamed polyurethane or rubber. It is desired that the materials of the peripheral seal member 25 have a low coefficient of friction to reduce the rotation resistance of the cylinder member 12 on the toner replenishing device.

It is also possible to reduce the resistance by using materials having a low degree of friction for the peripheral surface of the cap 13. Further, it is possible to adhere the peripheral seal member 25 to the cap 13 instead of to the cylinder member 12. Again, it is desirable to use materials having a low coefficient of friction to reduce rotation resistance of the toner container 11.

It is easier to adhere the peripheral seal member 25 on an outer peripheral surface of the cylinder member 12 than on the inner surface of the cap 13 when sealing the space between the outer peripheral surface and the inner peripheral surface to prevent toner from leaking. In case the projection 12*a* and the engaging projection 13*a* are formed on both peripheral surfaces, it is preferable that the seal member is adhered as far from the mouth portion end 16 as possible so as not to damage the seal member when assembling the cap 13 to the cylindrical member.

A shutter 18 which can open or shut the cap opening 17 is provided on the cap 13. The shutter 18 has a sector shape and a size such that it can cover the cap opening 17. The shutter 18 is rotationally mounted on the cap by its axis part 20 which fits in an axial hole 21 of the cap. A shutter guide 24 in the form of an arcuate wall is formed on the radial edge of the cap 13 to guide the shutter 18. An engaging portion 22 formed on the shutter can be turned in order to move the shutter 18. The shutter 18, like the cap, is made of resin such as acrylonitrile-butad-styrene (ABS) or polystyrene (PS), etc.

A cap opening seal member 23 is adhered to a surface of the shutter 18 to prevent toner from leaking from a space between the edge of the cap 13 around the cap opening 17 and the shutter 18. The seal member 23 is made of stable materials such as a foamed polyurethane or rubber. It is desired that the materials of the seal member 23 have a low coefficient of friction to reduce resistance to opening and shutting movement of the shutter 18. It is also possible to reduce resistance by using materials having a low degree of friction for the end of the cap 13 which contacts with the shutter 18. Further, it is possible to adhere the seal member 23 to the end of the cap 13 around the cap opening 17 instead of to the surface of the shutter 18. In this case, the resistance to opening and shutting movement can be reduced when the surface of the shutter 18 has a low coefficient of friction.

A gear 14 provides a drive element and is formed by forming teeth on a cylinder base, and mounting the base on an outer peripheral surface of the cylinder member 12 as shown in FIG. 1. A cut-out 26 of the gear engages with a projection 27 of the cylinder member 12 in order to reliably transmit torque to the cylinder member 12. It is possible to form the gear 14 integratedly with the cylinder member 12. It is also possible to form an engaging portion such as a projection or a dent for engaging with a driving gear 31 on a back end wall of the cylinder member 12. In this case, the engaging portion of a driving mechanism of the toner replenishing device for driving the cylinder member 12 is constructed in correspondence to the position and shape of the engaging portion on the toner container 11, and the cylinder member 12 is rotated by the engaging of the engaging portions.

Next, description will be given of the toner replenishing device according to the present invention. FIG.4(*a*) is a perspective view showing an important part of the toner container 11 and a toner replenishing device. The toner replenishing device according to the present invention is comprised of four major components: a toner container holder 30 for holding the toner container 11, a driving gear 31 for driving the cylinder member 12, a cap stopper portion 32*a* and a shutter mechanism which is comprised of a shutter connecting member 33 having an axis 33*a*, an operating portion 34 and a coupling member 34*a*. The toner container holder 30 has a structure which can rotationally support the cylinder member 12 of the toner container 11. As shown in FIG. 3, a cap cover 32 for covering the cap 13 of the toner container 11 is provided to prevent toner from leaking to the outside.

Figure 6:
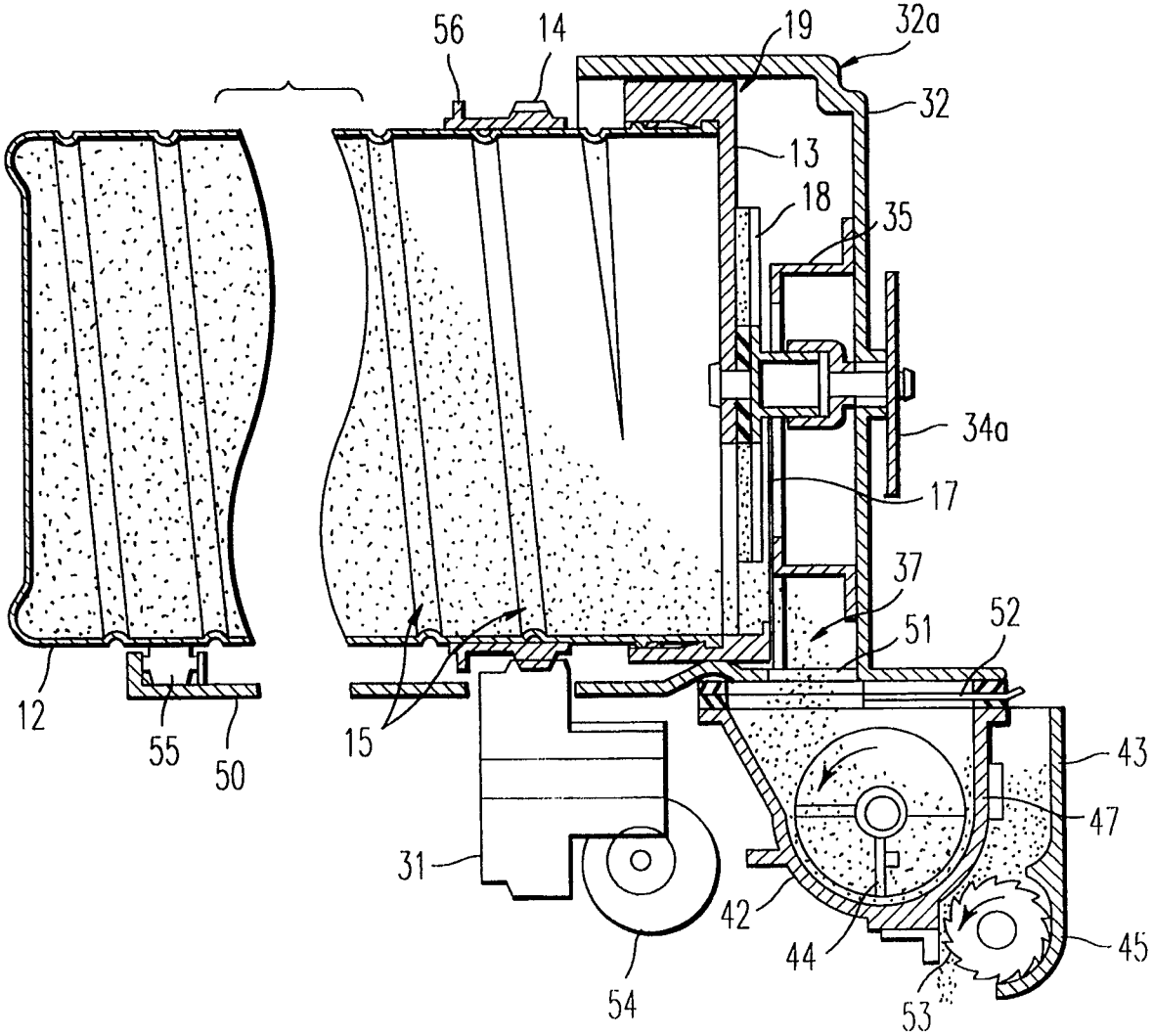
FIG. 6 is a sectional view which is taken along the line VI—VI of FIG. 5.
Figure 7A:
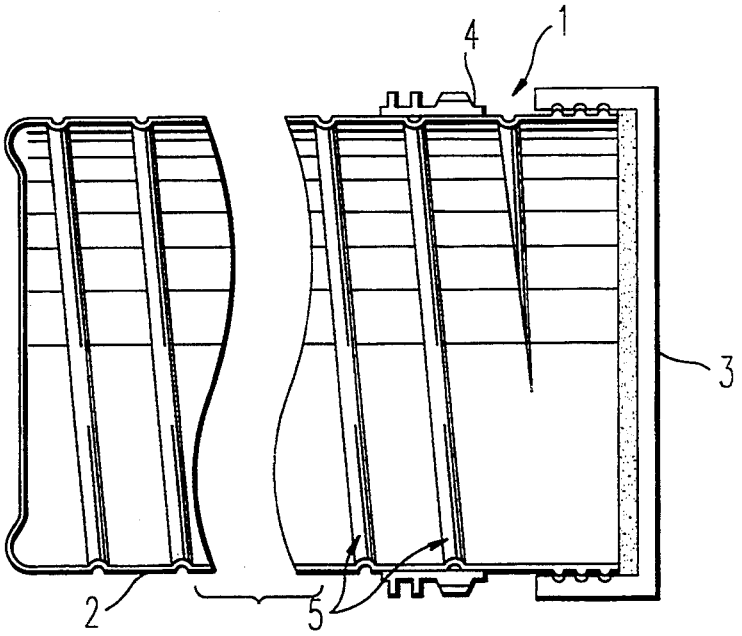
FIG. 7a PRIOR ART
FIG. 7(*a*) is a longitudinal sectional view of a conventional toner container.
Figure 7B:
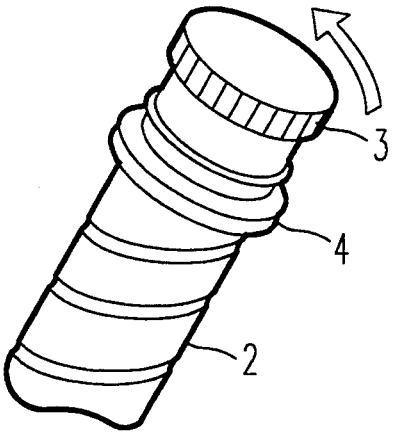
FIG. 7b PRIOR ART
Figure 7C:
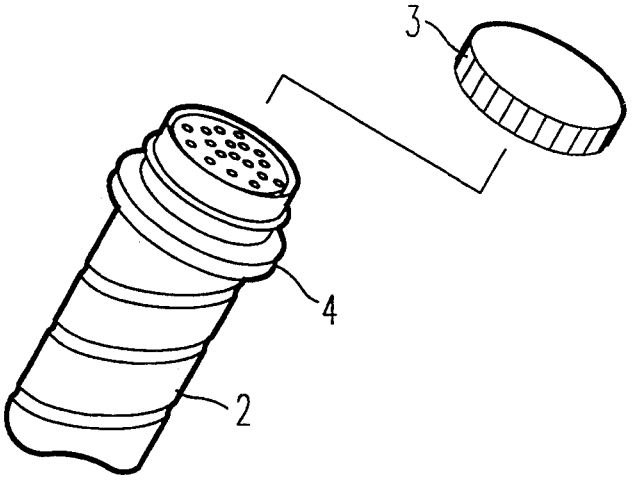
FIG. 7c PRIOR ART
Figure 8:
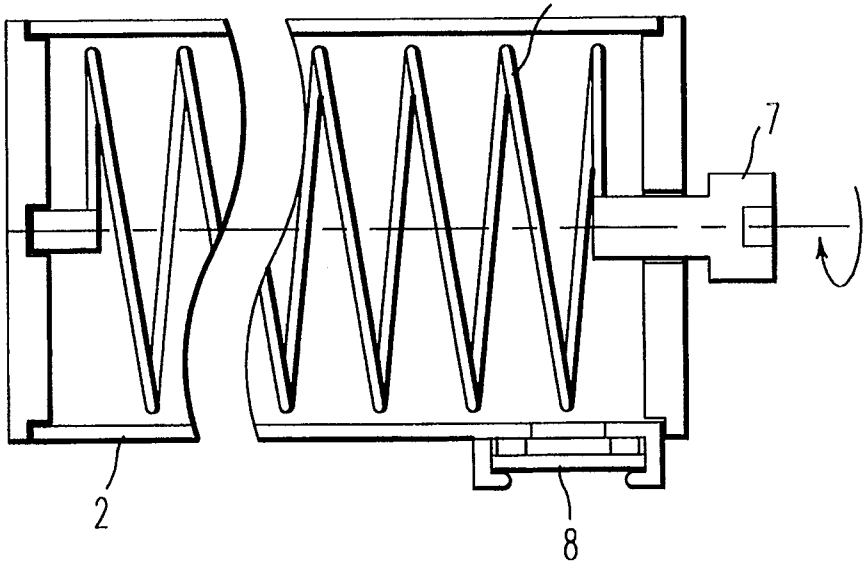
FIG. 8 PRIOR ART
FIG. 8 is a longitudinal sectional view of a toner container relating to other conventional art.

The driving gear 31 mates with the gear 14 of the cylinder member 12 mounted to the toner container holder 30 so that they can rotate the cylinder member 12. The driving gear 31 extends partially from a hole which is formed on a surface 50 of the toner container holder 30. As shown in FIG. 6, the driving gear 31 is connected to a driving motor 54 which is disposed under the upper surface 50 to drive the driving gear 31.

The cap stopper portion 32*a* of the cap cover 32 engages with the cap side engaging portion 19 of the cap 13 so that the cap 13 does not rotate with the cylinder member 12 when the cylinder member 12 is rotated by the driving gear 31. More particularly, an upper portion of a peripheral wall of the cover 32 extends upward so that a space of a width y is formed in the cap cover, and so that the cap side engaging portion 19 of a width x ($x<y$) can be introduced into the space. The side wall of the cap side engaging portion 19 contacts with a side wall of the cap stopper portion 32*a* whereby the cap stopper portion 32*a* and a cap side engaging portion 19 prevent the cap from rotating.

The shutter mechanism is capable of moving the shutter 18 so that it opens the cap opening 17 by engaging with the engaging portion 22. For this purpose, the shutter mechanism has the shutter connecting member 33 and the operating portion 34. The shutter connecting member 33 has a recess into which can be inserted the engaging portion 22 of the shutter 18. An axis 33a of the shutter connecting member 33 penetrates the end wall of the cover 32 and the operating portion 34 is connected to the axis of the shutter connecting member 33 via the coupling member 34*a*.

The shutter connecting member 33, etc. are provided in a space partitioned by the section plate 35 and a connecting opening 36 is formed in the section plate to permit entry of the engaging portion 22 into the space partitioned by the section plate 35 when the cap 13 of the toner container 11 is introduced into the cover portion 32. A toner inlet opening 37 can then receive toner from the cap opening 17 which is opened by the shutter mechanism.

A description will now be given of attachment and detachment of the toner container 11 to the toner replenishing device. Referring to FIG. 4(*a*), the toner container 11 is inserted in the cover portion 32 so that the cap side engaging portion 19 enters the cap stopper portion 32*a*. At this time, the engaging portion 22 (refer to FIGS. 1 and 2) is introduced into the recess of the shutter connecting member 33 through the connecting opening 36. The gear 14 of the toner container 12 meshes with the driving gear 31 upon such insertion. Next, the operating portion 34 is moved in a direction which is shown by an arrow, so that the shutter connecting member 33 is rotated via the axis which is fixed the operation portion 34. The shutter 18 is thereby moved to a position to open the cap opening 17 via the engaging portion 22 which is fitted in the shutter connecting member 33.

FIG. 4(*b*) is a view showing a state in which the shutter 18 is at the open position. As shown by dotted lines in FIG. 4(*b*) , if an operator pulls on the toner container 11 in this state, it can not be removed because the shutter side connection 22 is held at the reverse side of the section plate 35 of the cover portion 32. The section plate 35 thus has a function to prevent the toner container 11 from being inadvertently removed.

The attachment of the toner container 11 is thus completed. Detaching it from the toner replenishing device is done by operations opposite in order from those of the attachment operation.

Figure 5:
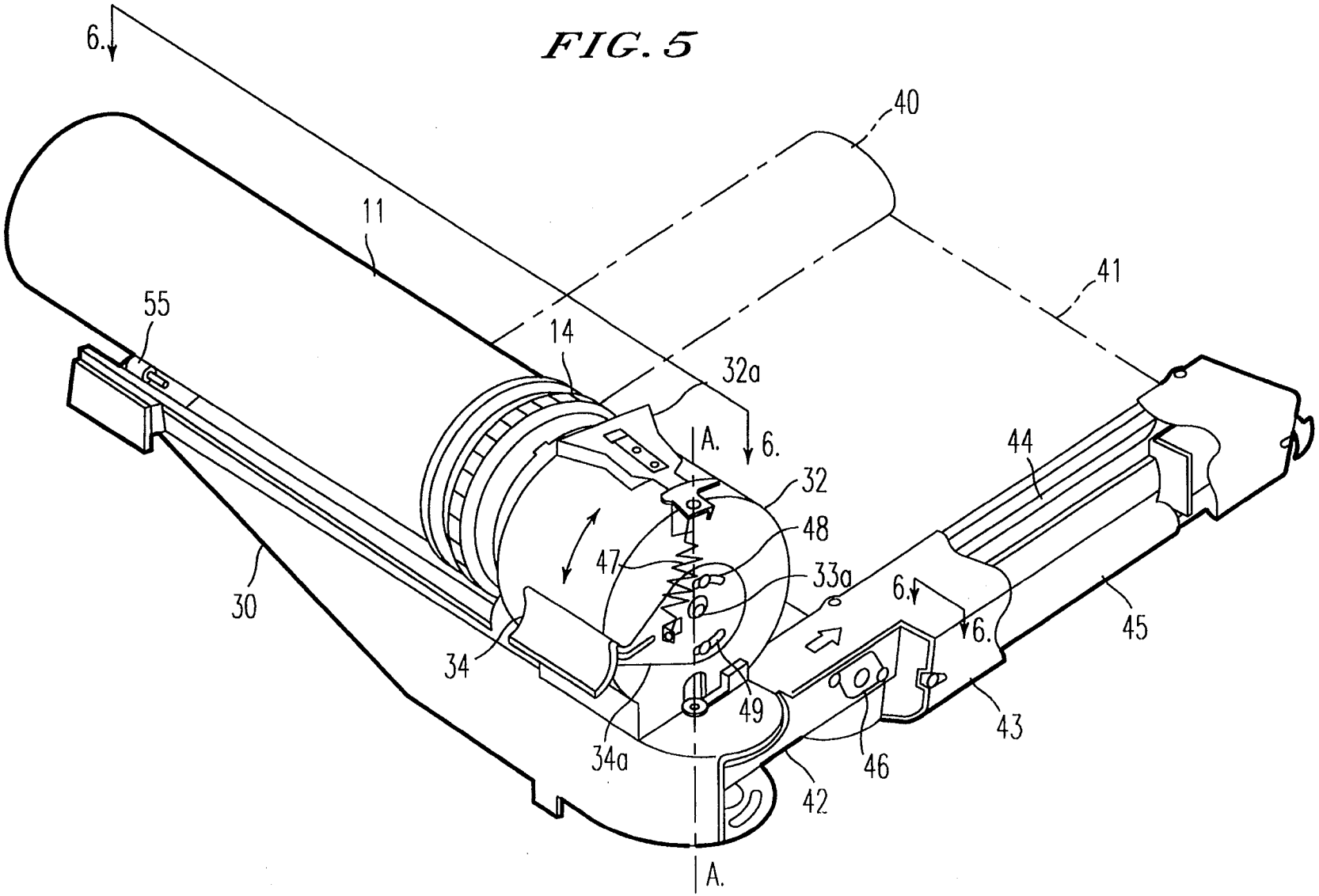
FIG. 5 is a perspective view showing the entire toner replenishing device.

Next, description will be given of an embodiment of the toner replenishing device. FIG. 5 is a perspective view showing the whole toner replenishing device. FIG. 6 is a sectional view which is taken along the lines VI—VI of FIG. 5. Referring to FIG. 5, a developing unit 41 has a developing roller (not shown), etc. which are disposed in an opening facing a surface of a photoconductive drum 40. The toner container holder 30 of the toner replenishing device holds the toner container 11 horizontally at a front side of the photoconductive drum 40 and the developing unit 41, i.e., at a first position where the axis of the toner container 11 and an axis of the photoconductive drum 40 cross perpendicularly. The toner container holder 30 is rotated between the first position and a second position where the container holder 30 is rotated at an angle of about 90 degrees with respect to the first position around a vertical axis (shown as line A—A) so that a back end of the toner container 11 moves to a position in front of an operator. At the first position, it is available to feed toner to the developing unit. At the second position, the toner container 11 will be removable and easy to replace.

The toner replenishing device further has a toner transport member 42 for transporting toner to the developing unit 41 of the image forming apparatus from the toner container 11 and a hopper 43 for storing the transported toner and for replenishing toner into the developing unit 41 if necessary. The inside of the toner replenishing device is connected to the toner transport member 42. Both the toner transport member 42 and the hopper 43 are fixed to the developing unit 41. A toner transport plate 44 extends into the toner transport member 42 and the hopper 43, and transports toner to the inner part of the toner transporting member 42 by its rotation. A toner replenishing roller 45 is provided in a connecting portion between the hopper 43 and the developing unit 41. A front end portion of the toner transport member 42 is located under the toner inlet opening 37 of the section plate 35 which is provided in the cover portion 32, and the toner transport member 42 has a opening which is formed on the upper surface 50 of the toner container holder 30 to receive toner dropping from a toner dropping opening 51. A manual shutter 52 is provided to close the toner dropping opening 51 for maintenance. As shown in FIG. 5, a toner sensor 46 is disposed on the toner transport member 42 to detect toner.

As shown in FIG. 5, a roller 55 for supporting a back end portion of the toner container 11 is provided on the toner container holder 30. Also, the coupling member 34*a* is forced clockwise by a spring 47. Holes 48 which are circular arc in shape are formed on the coupling member 34*a* and the circular arcs are coaxial with the axis 33*a*. The rotatable extent of the coupling member 34*a* is limited by cooperation of the holes 48 and pins 49 which are provided on an end wall of the cover portion 32 is inserted in the holes 48.

The limit of the rotatable extent in a clockwise direction is defined as a position where the shutter connecting member 33 can receive the engaging portion 22 of the shutter 18 which is at a closed position of the cap opening 17 as shown in FIG. 4(*a*). On the other hand, the limit of the rotatable extent in a counterclockwise direction is set as a position where the shutter connecting member 33 can make the shutter 18 open the cap opening 17. The spring 47 makes the shutter connecting member 33 return to the limit position in the clockwise direction and hold it after the toner container 11 is taken away for replacement. It is thereby assured that the shutter connecting member 33 receives the engaging portion 22 when the toner container 11 is attached.

It is possible that the shutter connecting member 33 can hold the coupling member 34*a* at the limit position in a counterclockwise direction to open the cap opening 17 by manually moving the shutter 18 via the operating portion 34 after the attachment of the toner container 11. The holes 48 could have a projections so that the holes 48 can lock the pins 49 at the limit position in the counterclockwise direction. The lock could then not be released and the coupling member 34*a* could not rotate as long as the operating portion 34 is not operated by a predetermined force which is at least bigger than the force of the spring 47.

As shown in FIG. 6, a plate 53 which has slits is provided on the toner replenishing device so that the distal end of the plate 53 contacts with a peripheral surface of the toner replenishing roller 45.

A ring-shaped projection 56 is integratedly combined with the gear 14. When the ring-shaped projection 56 contacts with a portion adjacent to the teeth portion of the driving gear 31, the positioning function is obtained between the gear 14 and the driving gear 31. Further, when the ring-shaped projection 56 contacts with an upper end portion of the toner container holder 30, a supporting function of the cylinder 12 is obtained on the upper end portion.

Again referring to FIG. 6, a description will be given of the toner replenishing process performed by the toner replenishing device. Based on control signals from the image forming apparatus, the toner replenishing roller 45 is driven and a certain amount of toner is fed into the developing unit 4 by the toner replenishing roller 45 of the hopper 43 and the plate 53 with slits. At this time, the toner transport plate 44 of the toner transporting member 42 also rotates and toner is transported toward the toner replenishing roller 45 from the front end portion side of the toner transport member 42 so that toner reaches the toner replenishing roller 45. During such a series of steps, the toner sensor 46 of the hopper 43 detects whether or not the toner exists (toner level).

When the sensor detects a signal of no toner, a control unit of the main body (not shown) sends a driving signal to the driving motor 54 for rotating the cylinder member 12, the driving gear 31 is supplied with a torque and the cylinder member 12 is rotated via of the toner container 11. At this time, the cap 13 is held in the cap stopper portion 32*a* of the cover 32 and so only the cylinder member 12 rotates. During such rotation, the ring-shaped projection 56 is supported by the upper end portion of the toner container holder 30 at the cap 13 side of the cylinder member 12, whereas the roller 55 supports the cylinder member 12 at the opposite side. Due to the rotation of the cylinder member 12, toner within cylinder member 12 is transported toward the cap opening 17 by the toner transport projection 15 and discharged to the front end of the toner transport member 42 via the cap opening 17 and the toner dropping opening 51, and further is transported toward the hopper 43 by the toner transport plate 44. The driving motor 54 stops and the cylinder member 12 also stops when the toner sensor 46 detects the toner.

In the above mentioned embodiment, toner is replenished after opening the cap 13 by the manual operation of the operating portion 34. However, it is possible to provide an automatic opening-and-shutting mechanism to automatically move the cap 13 when the toner container 11 is attached to the toner holder 30.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A toner container rotatably mountable to a toner replenishing device for discharging toner to the toner replenishing device upon rotation of the toner container, comprising:

a cylindrical member for containing toner to be discharged, said cylindrical member having a mouth portion adjacent one end thereof;

a cap member covering the mouth portion and fittable in the toner replenishing device when said cylindrical member is rotatably mounted to the toner replenishing device, said cap member being rotationally movably attached relative to said cylindrical member such that said cap member can remain stationary without becoming detached from said cylindrical member when said cylindrical member is rotated, said cap member having an opening through which toner can be discharged and an engaging portion which cooperates with the toner replenishing device to prevent rotation of the cap member relative to the toner replenishing device when said cylindrical member is rotatably mounted to the toner replenishing device; and a shutter mounted to said cap member so as to selectively close said opening.

2. A toner container according to claim 1, including a seal member provided on said cap member so as to seal a space between said the cap member and said shutter.

3. A toner container according to claim 1, including a seal member provided on said shutter so as to seal a space between said cap member and said shutter.

4. A toner container according to claim 1, wherein said shutter has a sector shape.

5. A toner container according to claim 1, including a drive element coupled to said cylindrical member for transmitting rotational torque to said cylindrical member when said cylindrical member is mounted to the toner replenishing device.

6. A toner container according to claim 5 wherein said drive element comprises a gear mounted circumferentially on said cylindrical member.

7. A toner container according to claim 1 including a seal member sealing a gap between said cylindrical member and said cap member.

8. A toner container according to claim 7 including low friction material at said gap.

9. A toner container according to claim 7 wherein said seal member includes a low friction material.

10. A toner container according to claim 1 including annular projections on said cylindrical member and said cap member, which projections cooperate to retain said cap member mounted on said cylindrical member while permitting said cap member to rotate on said cylindrical member.

11. A toner container according to claim 10 including a seal member sealing a gap between said cylindrical member and said cap member.

12. A toner replenishing system comprising:

a toner container including a cylindrical member for containing toner to be discharged, said cylindrical member having a mouth portion adjacent one end thereof, said toner container further comprising a cap member covering the mouth portion and rotatably movably mounted relative to said cylindrical member such that said cap member can remain stationary without becoming detached from said cylindrical member when said cylindrical member is rotated, said cap member having an opening through which toner can be discharged;

a shutter mounted to said cap member so as to selectively close said opening;

a toner replenishing device onto which said cylindrical member may be rotatably mounted, said toner replenishing device including a holder portion which receives the cap member when said cylindrical member is rotatably mounted thereto, said toner replenishing device further comprising a portion which prevents rotation of said cap member when said cylindrical member is rotatably mounted thereto, and a shutter opening portion which opens said shutter when said cylindrical member is rotatably mounted thereto;

a drive element coupled to said cylindrical member for transmitting rotational torque to said cylindrical member when said cylindrical member is mounted to the toner replenishing device; and a drive portion on said toner replenishing device which rotationally drives said drive element.

13. A toner replenishing system according to claim 12, including a seal member on said the cap member to seal a gap between said cap member and said shutter.

14. A toner replenishing system according to claim 12, including a seal member on said shutter to seal a gap between said the cap member and said shutter.

15. A toner replenishing system according to claim 12 wherein said shutter opening portion comprises:

a shutter connecting mechanism engaging said shutter when said cylindrical member is mounted to said toner replenishing device, said shutter connecting mechanism being mounted on an axis for rotation to open said shutter;

an operating portion external of said holder portion; and a coupling member connecting said operating portion to said axis such that said shutter can be opened by a force applied external to said holder portion.

16. A toner replenishing system according to claim 12 including a spring biasing said shutter into a closed position.

17. A toner replenishing system according to claim 12, wherein said holder portion includes a section plate partitioning a space in said holder portion, and a connection opening in said section plate.

18. A toner replenishing system according to claim 17, wherein said shutter includes an engaging portion which fits through said connection opening and into said space when said cylindrical member is rotatably mounted to said toner replenishing device.

19. A toner replenishing system according to claim 18, wherein said shutter opening portion includes a shutter connecting mechanism in said space and engaging said engaging portion when said cylindrical member is mounted to said toner replenishing device, said shutter connecting mechanism being mounted for rotation so as to rotate said engaging portion of said shutter engaged therewith to open said shutter, wherein said connection opening is shaped to prevent passage of said engaging portion rotated by said shutter connecting mechanism so that said toner container cannot be removed from said toner replenishing device when said shutter is opened.

20. A cap member for use with a cylindrical member of a toner container rotatably mountable to a toner replenishing device for discharging toner to the toner replenishing device upon rotation of the toner container, comprising:

a cap element having a rotational mounting part which is cooperable with said cylindrical member for rotatably mounting said cap element to said cylindrical member;

a cap opening in said cap element for discharging toner when said cap element is mounted to said cylindrical member;

a shutter for opening or closing said cap opening; and an engaging portion associated with said shutter for engaging with a shutter mechanism of the toner replenishing device when said cap member is mounted to said cylindrical member mounted to the toner replenishing device.

21. A cap member according to claim 20, wherein said cap opening has a sector shape.

22. A cap member according to claim 20, wherein said shutter has a sector shape.

23. A cap member according to claim 20, including a guide mounted to said cap element for guiding said shutter.

24. A cap member according to claim 20, including a seal member provided on said shutter so as to seal a space between said cap member and said shutter.

* * * * *